US007794032B2

(12) United States Patent
Kimura

(10) Patent No.: US 7,794,032 B2
(45) Date of Patent: Sep. 14, 2010

(54) LIQUID EJECTING APPARATUS, LIQUID CONTAINER, AND METHOD FOR DETERMINING LIQUID LEVEL OF LIQUID CONTAINER

(75) Inventor: Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 664 days.

(21) Appl. No.: 11/828,873

(22) Filed: Jul. 26, 2007

(65) Prior Publication Data

US 2008/0024555 A1 Jan. 31, 2008

(30) Foreign Application Priority Data

Jul. 26, 2006 (JP) ..... 2006-202969

(51) Int. Cl.
*B41J 2/175* (2006.01)

(52) U.S. Cl. ..... 347/7; 347/85

(58) Field of Classification Search ..... 347/7, 347/14, 17, 19, 20, 6, 84–87
See application file for complete search history.

(56) References Cited

U.S. PATENT DOCUMENTS 6,698,869 B2 * 3/2004 Vosahlo ..... 347/85
6,796,627 B2 * 9/2004 Kimura et al. ..... 347/7

FOREIGN PATENT DOCUMENTS

JP 2001-212974 A 8/2001
JP 2001-253085 A 9/2001
JP 2002-52737 A 2/2002
JP 2002-154219 A 5/2002
JP 2002-178498 A 6/2002
JP 2002-187292 A 7/2002

* cited by examiner

*Primary Examiner*—Juanita D Stephens
(74) *Attorney, Agent, or Firm*—Sughrue Mion, PLLC

(57) ABSTRACT

A liquid ejecting apparatus includes: a liquid ejecting head that can eject liquid; a pressure pump that discharges pressurized air during operation; at least one liquid container that contains liquid; a pressurized-air feed channel that feeds the liquid container with the pressurized air discharged from the pressure pump; a liquid feed channel that feeds the liquid ejecting head with the liquid discharged from the liquid container in accordance with the pressure of the pressurized air that is fed to the liquid container through the pressurized-air feed channel; a hydraulic-pressure measuring device disposed in a no pressure region that is not under the pressure of the pressurized air, for measuring the pressure of the liquid fed from the liquid container to the liquid ejecting head; a determining section that determines, if the hydraulic-pressure measuring device detects a value lower than a threshold hydraulic pressure predetermined as the lower limit of the hydraulic pressure necessary for feeding the liquid from the liquid container to the liquid ejecting head during the period from the start to the end of the operation of the pressure pump or immediately after the operation stops, that the liquid container has run out or is about to run out of liquid; and a controller that controls the operation of the pressure pump on the basis of the measurement of the hydraulic-pressure measuring device.

10 Claims, 8 Drawing Sheets

LIQUID EJECTING APPARATUS, LIQUID CONTAINER, AND METHOD FOR DETERMINING LIQUID LEVEL OF LIQUID CONTAINER

BACKGROUND

1. Technical Field

The present invention relates to a liquid ejecting apparatus, and a liquid container of an ink jet printer or the like, and also to a method for determining the liquid level of the liquid container.

2. Related Art

An ink jet recording apparatus is a kind of known liquid ejecting apparatus that ejects liquid from a liquid ejecting head to a target. Hereafter, such devices may, without loss of generality, be referred to using the linguistically convenient term, "printer". Printers are equipped with an ink cartridge (liquid container) for holding ink (liquid), and with a recording head (liquid ejecting head) for ejecting ink. Printers may execute printing operations in part by feeding pressurized air from a pressure pump through an air feed channel into the ink cartridge to pressurize an ink pack in the ink cartridge, thereby feeding ink to the recording head through an ink feed channel (liquid feed channel), and ejecting the ink from the nozzle of the recording head to a recording medium.

However, such printers have a disadvantage such that, if the pressure of the pressurized air that pressurizes the ink pack in the ink cartridge drops excessively while the pressure pump is at a standstill, sufficient ink is not fed to the recording head, causing problems in printing. To address this sort of problem, the printers described in JP-A-2001-212974 and JP-A-2001-253085 are configured to drive a pressure pump when a pressure sensor, disposed along the air feed channel serving as a pressure region, detects the lower limit of the pressure necessary for feeding ink from the ink cartridge to the recording head.

However, printers configured as described in the preceding paragraph have a problem such that, when the ink pack is about to run out of ink, a sufficient amount of ink necessary for printing is not supplied to the recording head even though the pressure pump is driven to apply pressure to the ink pack. To address this kind of problem, the printer described in JP-A-2002-154219 is equipped with a pressure sensor, in a pneumatic chamber serving as a pressure region in the ink cartridge, with which a difference, between the pressure of the pressurized air in the pneumatic chamber and the pressure of ink supplied from the ink pack to the recording head, is measured, thereby checking the ink level.

However, the printer described in JP-A-2002-154219 has low design flexibility because the location of the pressure sensor is limited to the boundary between the pressure region and the no pressure region in the ink cartridge. This is because the difference between the pressure of the pressurized air in the pneumatic chamber and the pressure of the ink supplied from the ink pack to the recording head, is measured. This reduced flexibility in design is a problem.

SUMMARY

An objective of some aspects of the invention includes providing a liquid ejecting apparatus with high design flexibility which allows an appropriate determination of whether the liquid container has run out or is about to run out of liquid, a liquid container, and a method for determining the liquid level of the liquid container.

According to a first aspect of the invention, there is provided a liquid ejecting apparatus including: a liquid ejecting head that can eject liquid; a pressure pump that discharges pressurized air during operation; at least one liquid container that contains liquid; a pressurized-air feed channel that feeds the liquid container with the pressurized air discharged from the pressure pump; a liquid feed channel that feeds the liquid ejecting head with the liquid discharged from the liquid container in accordance with the pressure of the pressurized air that is fed to the liquid container through the pressurized-air feed channel; a hydraulic-pressure measuring device disposed in a no pressure region that is not under the pressure of the pressurized air, for measuring the pressure of the liquid fed from the liquid container to the liquid ejecting head; a determining section that determines, if the hydraulic-pressure measuring device detects a value lower than a threshold hydraulic pressure predetermined as the lower limit of the hydraulic pressure necessary for feeding the liquid from the liquid container to the liquid ejecting head during the period from the start to the end of the operation of the pressure pump or immediately after the operation stops, that the liquid container has run out or is about to run out of liquid; and a controller that controls the operation of the pressure pump on the basis of the measurement of the hydraulic-pressure measuring device.

This arrangement allows an appropriate determination of whether the liquid container has run out or is about to run out of liquid by detecting a value lower than a threshold hydraulic pressure during the period from the start to the end of the operation of the pressure pump or immediately after the operation stops, that the liquid container has run out or is about to run out of liquid with the hydraulic-pressure measuring device. The hydraulic-pressure measuring device may be disposed anywhere of a no pressure region that is not pressurized by the pressure of the pressurized air, thus increasing design flexibility.

Preferably, the controller starts the operation of the pressure pump if the hydraulic-pressure measuring device detects a value lower than the threshold hydraulic pressure while the pressure pump is at a standstill.

In controlling the operation of the pressure pump, to feed liquid from the liquid container to the liquid ejecting head, the flexible bag (ink pack) housed in the liquid container and filled with liquid is in general elastically deformed in such a manner as to be pressed by the pressure of the pressurized air discharged from the pressure pump. Therefore, the pressurizing force in this case is determined in consideration of the pressure loss at the maximum flow rate, the difference between the heads of the liquid container and the liquid ejecting head, and the reaction force of the flexible bag.

Here, it is known in the art that the reaction force of the bag is low when the remaining liquid is enough but increases as the remaining liquid decreases. Therefore, in the pressure pump control of the related art, a pressurizing force in which a high reaction force at the run out of liquid is allowed is applied from the pressure pump to the liquid container at all times. As a result, the pressure pump is operated excessively so as to generate high pressurizing force in which the reaction force at the run-out of liquid is allowed even if sufficient liquid remains in the liquid container (specifically, in the bag), causing the problem of low pressurization control efficiency.

In contrast, according to an embodiment of the invention, the pressure pump is operated on the basis of the hydraulic pressure detected by the hydraulic-pressure measuring device disposed in a no pressure region. That is, the hydraulic pressure detected by the hydraulic-pressure measuring device becomes a value obtained by subtracting the reaction force of the bag corresponding to the actual remaining liquid from the pressurizing force. Therefore, the pressure pump can be controlled so that the detected hydraulic pressure is not lower than the sum of the pressure loss at the maximum liquid flow rate and the difference between the heads of the liquid container and the liquid ejecting head. This prevents excessive operation of the pressure pump to permit effective control by starting the operation of the pressure pump on the basis of the hydraulic pressure measured by the hydraulic-pressure measuring device disposed in the no pressure region.

Preferably, the liquid ejecting apparatus further includes at least one pressurizing-force measuring device that is disposed in a pressure region that is under the pressure of the pressurized air and that measures the pressure of the pressurized air. The controller may stop the operation of the pressure pump if the hydraulic-pressure measuring device detects a value equal to or higher than a threshold pressurizing force predetermined as the upper limit of the pressurizing force necessary for feeding the liquid from the liquid container to the liquid ejecting head after starting the operation of the pressure pump.

With this arrangement, the upper limit of the pressurizing force can be controlled correctly by controlling the pressure pump until the hydraulic-pressure measuring device detects a value equal to or higher than a threshold pressurizing force, thereby preventing the excessive operation of the pressure pump.

Preferably, the controller operates the pressure pump for a predetermined time necessary for increasing the pressurizing force to the upper limit of the pressurizing force necessary for feeding the liquid from the liquid container to the liquid ejecting head after starting the operation of the pressure pump.

This arrangement eliminates the need for the hydraulic-pressure measuring device to control the upper limit of the pressurizing force correctly. This arrangement thus allows appropriate control of the upper limit of the pressurizing force without an increase in the number of the components, thus preventing the excessive operation of the pressure pump.

Preferably, the liquid ejecting apparatus further includes an air relief valve that communicates the pressure region with the air when opened. If the hydraulic-pressure measuring device detects a value equal to or higher than an air-relieving threshold hydraulic pressure predetermined for opening the air relief valve, the controller may open the air relief valve.

If the hydraulic-pressure measuring device detects a value equal to or higher than a predetermined air-relieving threshold hydraulic pressure, this arrangement can prevent the pressurizing force from increasing excessively by opening the air relief valve to communicate the pressure region with the air.

Preferably, the at least one liquid container includes a plurality of liquid containers, and the at least one hydraulic-pressure measuring device includes a plurality of hydraulic-pressure measuring devices in one-to-one correspondence with the liquid containers.

With this arrangement, the plurality of liquid containers each have a corresponding individual hydraulic-pressure measuring device, thus allowing determination of the respective remaining liquid in the liquid containers even if the remaining amount changes among liquid containers.

Preferably, the liquid container is divided into a pressure region that is pressurized by the pressurized air and a no pressure region that is not pressurized by the pressurized air. The pressure region may contain the liquid, and the no pressure region may have the hydraulic-pressure measuring device.

With this arrangement, the hydraulic-pressure measuring device can be replaced every time the liquid container is replaced because the hydraulic-pressure measuring device is integrated with the liquid container. Thus, high reliability of the hydraulic-pressure measuring device can be maintained.

According to a second aspect of the invention, there is provided a liquid container mounted on the above-described liquid ejecting apparatus. The interior of the liquid container is divided into a pressure region that is pressurized by the pressurized air and a no pressure region that is not pressurized by the pressurized air, the pressure region containing the liquid, and the no pressure region having a hydraulic-pressure measuring device that detects the pressure of the liquid fed from the pressure region to the liquid ejecting head through the no pressure region.

With this arrangement, the hydraulic-pressure measuring device can be replaced every time the liquid container is replaced because the hydraulic-pressure measuring device is integrated with the liquid container. Thus, high reliability of the hydraulic-pressure measuring device can be maintained, and furthermore, the liquid container can be attached to an existing liquid ejecting apparatus having no hydraulic-pressure measuring device to check the liquid level.

According to a third aspect of the invention, there is provided a method for determining the liquid level of a liquid container. The method includes: measuring the pressure of the liquid fed from a liquid container to a liquid ejecting head in accordance with the pressure of the pressurized air discharged from a pressure pump by a hydraulic-pressure measuring device disposed in a no pressure region that is not pressurized by the pressurized air; and determining, if the hydraulic-pressure measuring device detects a value lower than a threshold hydraulic pressure predetermined as the lower limit of the hydraulic pressure necessary for feeding the liquid from the liquid container to the liquid ejecting head during the period from the start to the end of the operation of the pressure pump or immediately after the operation stops, that the liquid container has run out or is about to run out of liquid, that the liquid container has run out or is about to run out of liquid.

This arrangement allows appropriate determination of whether the liquid container has run out or is about to run out of liquid by detecting a value lower than a threshold hydraulic pressure during the period from the start to the end of the operation of the pressure pump or immediately after the operation stops with the hydraulic-pressure measuring device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

An ink jet printer according to a first embodiment of the invention will be described with reference to FIGS. 1 to 5. In the following description of this specification, "the front-back direction", "the longitudinal direction", and "the vertical direction" indicate the front-back direction (the subscanning direction) and the longitudinal direction (the main scanning direction) indicated by the arrows in FIG. 1 and the vertical direction (the direction of gravity), respectively.

Figure 1:
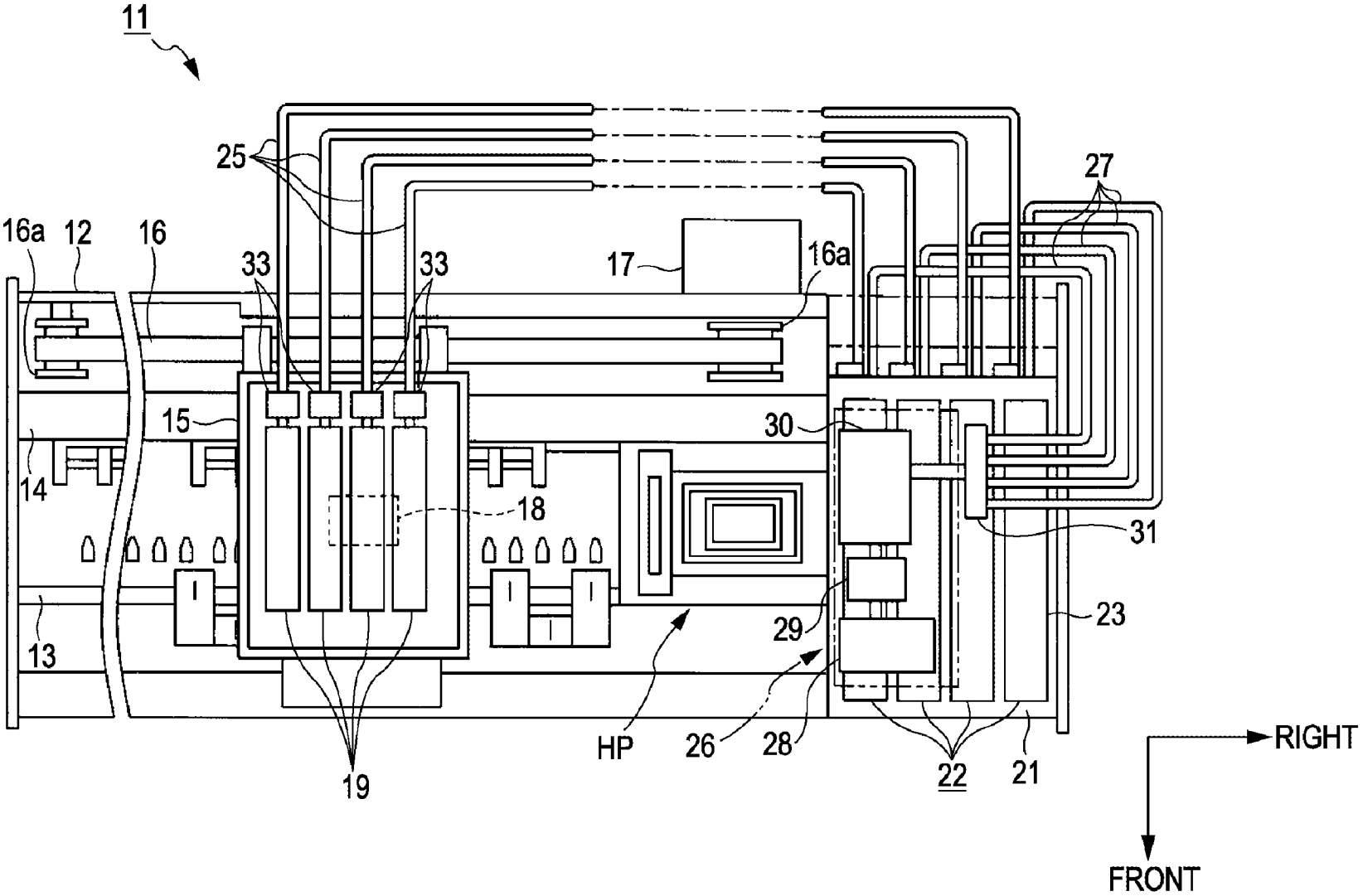
FIG. 1 is a schematic plan view of a printer which is a liquid ejecting apparatus according to embodiments of the invention.

As shown in FIG. 1, a printer 11 corresponding to a liquid ejecting apparatus of this embodiment includes a casing main body 12 in the shape of a substantially rectangular box. The casing main body 12 has a platen 13 at the lower part in the longitudinal direction. The platen 13 is a support for supporting target recording paper (not shown), onto which recording paper is fed in the front-back direction or the subscanning direction by a paper feed mechanism (not shown). The casing main body 12 also has a rod-like guide 14 parallel to the length of the platen 13 (in the longitudinal direction).

The guide 14 supports a carriage 15 such that it can reciprocate along the axis of the guide 14 (in the longitudinal direction). The carriage 15 is connected to a carriage motor 17 via an endless timing belt 16 stretched between a pair of pulleys 16*a*. Thus, the carriage 15 is driven by the carriage motor 17 to reciprocate along the guide 14.

Figure 2:
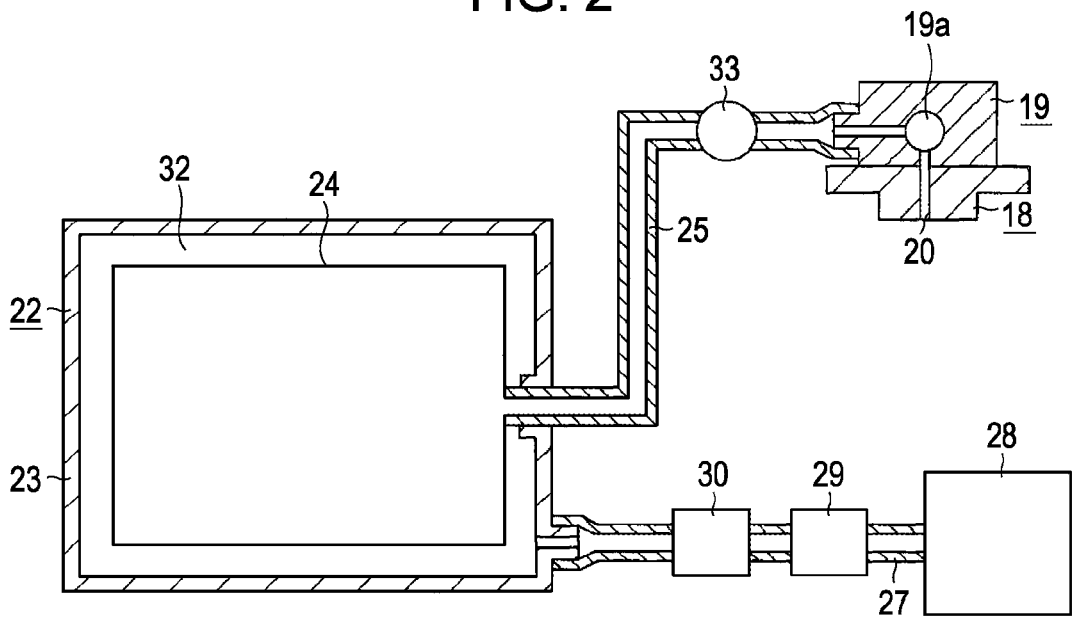
FIG. 2 is a schematic diagram illustrating the ink feed system of the printer according to a first embodiment of the invention.

The carriage 15 has a recording head 18 or a liquid ejecting head on the surface facing the platen 13. The carriage 15 also has thereon a plurality of (in this embodiment, four) valve units 19 that supply ink or liquid to the recording head 18 in correspondence with the colors (kinds) of the ink used in the ink jet printer 11. The recording head 18 has a plurality of nozzles 20 (see FIG. 2, only one is shown in FIG. 2) on the lower surface thereof Printing is executed by ejecting ink drops from the nozzles 20 onto the recording paper fed onto the platen 13.

A cartridge holder 21 is provided at the right end of the casing main body 12. Between the cartridge holder 21 and the platen 13 is provided a home position HP to which the recording head 18 is to be retracted. Before starting printing, cleaning and other various processes for the recording head 18 are executed in the home position HP.

A plurality of (in this embodiment, four) ink cartridges 22 or liquid containers are detachably attached to the cartridge holder 21. The ink cartridges 22 each have a rectangular box-shaped case 23. The cases 23 each accommodate a bag-shaped ink pack 24 (see FIG. 2) which is made of flexible film and filled with ink that varies in color from one ink cartridge 22 to another. The ink cartridges 22 are connected to the upper stream ends of respective ink feed channels 25 or liquid feed channels when attached to the cartridge holder 21, and thus connected to the respective valve units 19 on the carriage 15 through the ink feed channels 25. Each ink feed channel 25 has a hydraulic pressure sensor 33 or a hydraulic-pressure measuring device to be described later.

A pressurizing unit 26 is mounted at the right end of the casing main body 12 and on the cartridge holder 21. The pressurizing unit 26 is for feeding pressurized air (pressurized gas) through an air feed channel 27 or a pressure-air feed channel into the ink cartridges 22. The pressurizing unit 26 has a pressure pump 28, a pneumatic sensor 29 or a pneumatic-pressure measuring device, and an air relief valve 30. The pneumatic sensor 29 measures the pressure of the pressurized air (pneumatic pressure) flowing in the air feed channel 27, and outputs a detection signal corresponding to the detected pneumatic pressure Pa.

The air feed channel 27 branches from a distributor 31 disposed downstream from the air relief valve 30 into the same number as that of the ink cartridges 22. The ends (downstream ends)of the branch air feed channels 27 are connected to the corresponding ink cartridges 22 and communicate into the cases 23 of the ink cartridges 22. Accordingly, when the pressure pump 28 of the pressurizing unit 26 is driven, the pressurized air fed from the pressure pump 28 is introduced into the cases 23 of the ink cartridges 22 through the air feed channels 27, respectively. The ink packs are pressed by the pneumatic pressure of the pressurized air fed into the cases 23, and thus the ink in the ink packs 24 is fed under pressure to the recording head 18 through the ink feed channels 25.

As shown in FIG. 2, the ink pack 24 disposed in the case 23 of the ink cartridge 22 can introduce ink to the ink feed channel 25. The space between the case 23 and the ink pack 24 functions as a pressure chamber 32. The pressurized air fed from the pressure pump 28 through the air feed channel 27 is introduced into the pressure chamber 32. The air feed channel 27 and the pressure chamber 32 which are pressurized by the pressure of the pressurized air fed from the pressure pump 28 are pressure regions. In contrast, the ink feed channel 25 to which the ink fed from the ink pack 24 by the pressurized air is introduced is a no pressure region because it is not pressurized by the pressure of the pressurized air fed from the pressure pump 28.

The hydraulic pressure sensor 33 disposed along each ink feed channel 25, that is a no pressure region, measures the pressure (hydraulic pressure) of the ink flowing in the ink feed channel 25, and outputs a detection signal corresponding to the measured hydraulic pressure Pi. The ink feed channel 25 communicates with the nozzle 20 formed at the lower surface of the recording head 18. The valve unit 19 has a pressure control valve 19*a*. The valve element of the pressure control valve 19*a* is always urged into a closed state, and is opened according to the pressure downstream from the valve element (negative pressure generated with ejection of ink from the nozzle 20).

There is a display panel 34 (see FIG. 3) or an output section on the upper surface of the casing main body 12. The display panel 34 is configured to display various information such as error information when a display driving signal is input to the driving circuit (not shown) for the display panel 34.

Figure 3:
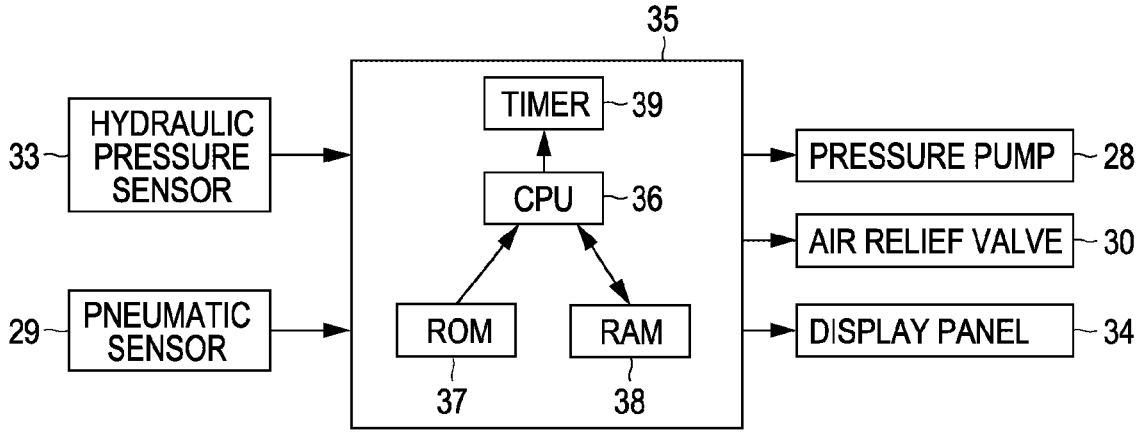
FIG. 3 is a block diagram illustrating the electrical structure of the printer according to the first embodiment.

Referring to FIG. 3, the electrical structure of the printer 11 will be described.

As shown in FIG. 3, the printer 11 has a control unit 35 serving as a controller and a determining section. The control unit 35 is principally comprised of an input-side interface (not shown), an output-side interface (not shown), a digital computer having a CPU 36, a ROM 37, a RAM 38, and a timer 39, and driving circuits (not shown) for driving various mechanisms (the pressure pump 28 etc.).

The input-side interface is electrically connected to the hydraulic pressure sensor 33 and the pneumatic sensor 29.

The output-side interface is electrically connected to the pressure pump 28, the air relief valve 30, and the display panel 34. The control unit 35 controls the mechanisms including the pressure pump 28 in response to various driving signals according to the detection signals from the hydraulic pressure sensor 33 and the pneumatic sensor 29.

The ROM 37 of the digital computer stores control programs for controlling the mechanisms including the pressure pump 28. The RAM 38 is configured to store various information (e.g., detected values indicated by the signals from the hydraulic pressure sensor 33 and the pneumatic sensor 29) which is rewritten during the operation of the printer 11. The timer 39 counts operation time (e.g., operation time Tp of the pressure pump 28).

The printer 11 is constructed such that, if any of the hydraulic pressure sensors 33 disposed along respective ink feed channels 25 detects a hydraulic pressure Pi lower than a predetermined threshold hydraulic pressure P1 while the pressure pump 28 is at a standstill, the control unit 35 sends a driving signal to the pressure pump 28 according to a program to start the operation of the pressure pump 28. When the pressure of the air flowing in the air feed channel 27 is increased by the operation of the pressure pump 28, so that the pneumatic sensor 29 detects a pneumatic pressure Pa equal to or higher than a predetermined threshold pressurizing force P2, the control unit 35 sends an operation stop signal to the pressure pump 28 according to the program to stop the operation of the pressure pump 28.

If the hydraulic pressure sensor 33 detects a hydraulic pressure Pi lower than the threshold hydraulic pressure P1 during the period from the start to the end of the operation of the pressure pump 28, the control unit 35 determines that the ink cartridge 22 connected to the ink feed channel 25 at which the hydraulic pressure Pi lower than the threshold hydraulic pressure P1 is detected is about to run out of ink. This may be thought of as an example of a low ink condition. The control unit 35 then outputs a display driving signal for displaying the determination to the driving circuit (not shown) for the display panel 34.

The hydraulic pressure sensor 33 may detect a hydraulic pressure Pi equal to or higher than a predetermined air relieving threshold hydraulic pressure P3 when the pressure (hydraulic pressure) of the ink flowing in the ink feed channels 25 becomes excessive due to some trouble. In this case, the control unit 35 receives the detection signal from the hydraulic pressure sensor 33 and sends a driving signal to the air relief valve 30 according to the program to open the air relief valve 30, thereby relieving the pressure in the air feed channel 27 into the air.

Thus, the pneumatic pressure in the pressure region and the hydraulic pressure in the no pressure region of the printer 11 are held within a predetermined pressure range. If it is determined that any of the ink cartridges 22 is about to run out of ink, the determination is displayed on the display panel 34.

Referring to the flowchart of FIG. 4, of the control routines executed by the control unit 35 of this embodiment, a pressurization control routine including ink level determination will be described.

In the pressurization control routine, the control unit 35 determines whether the hydraulic pressure Pi detected by any of the hydraulic pressure sensors 33 during the standstill of the pressure pump 28 is lower than the threshold hydraulic pressure P1 (step S10). If the determination is negative, the control unit 35 terminates this routine. If the determination in step S10 is positive, the control unit 35 outputs a driving signal to the driving circuit for the pressure pump 28 to start the operation of the pressure pump 28 (step S11).

Subsequently, the control unit 35 determines whether the hydraulic pressure Pi detected by the hydraulic pressure sensor 33 is equal to or higher than the threshold hydraulic pressure P1 (step S12). If the determination in step S12 is positive, the control unit 35 determines whether the pneumatic pressure Pa detected by the pneumatic sensor 29 is equal to or higher than the threshold pressurizing force P2 (step S13). If the determination is negative, the control unit 35 executes the determination of step S13 again. In contrast, if the determination in step S13 is positive, the control unit 35 outputs an operation stop signal to the driving circuit for the pressure pump 28 to stop the operation of the pressure pump 28 (step S14), and terminates the routine.

On the other hand, if the determination in step S12 is negative, the control unit 35 checks the ink level. That is, if it is determined that the pressure (hydraulic pressure) in the ink feed channels 25 is lower than the threshold hydraulic pressure P1 although the pressure pump 28 is driven, the control unit 35 determines whether the pressure pump 28 is in operation (step S15). If the determination in step S15 is positive, the control unit 35 determines that the ink cartridge 22 connected to the ink feed channel 25 in which the hydraulic pressure Pi lower than the threshold hydraulic pressure P1 is detected in steps S10 and S12 is about to run out of ink (step S16) and thus experiences a low ink condition. Then, the control unit 35 outputs a display driving signal for displaying the determination to the driving circuit for the display panel 34 (step S17), and terminates the routine.

The operation of the printer 11 will next be described.

If any of the hydraulic pressure sensors 33 disposed along the ink feed channels 25 detects a hydraulic pressure Pi lower than the threshold hydraulic pressure P1, the operation of the pressure pump 28 is started. When the pressure pump 28 is started, so that the hydraulic pressure Pi of the hydraulic pressure sensor 33 becomes equal to or higher than the threshold hydraulic pressure P1, the ink is fed to the recording head 18, because the pressure of the ink flowing in the ink feed channel 25 has increased. Subsequently, when the pneumatic pressure Pa sensed by the pneumatic sensor 29 disposed in the air feed channel 27 becomes equal to or higher than the threshold pressurizing force P2, the pressure pump 28 is stopped.

Thus, the hydraulic pressure of the no pressure region (the pressure of the ink flowing in the ink feed channel 25) is maintained within a predetermined range necessary for feeding the ink from the ink cartridge 22 to the recording head 18.

The pressure that the pressure pump 28 should apply to feed the ink from the ink cartridge 22 to the recording head 18 is determined in consideration of a variety of factors which include the pressure loss at the maximum ink flow rate, the difference between the heads of the ink cartridge 22 and the recording head 18, and the reaction force of the ink pack 24 which is pressed by the pressurizing force of the pressure air to feed the ink.

Among these factors, the pressure loss and the difference in head are not changed with the changes in the ink level. Accordingly, the pressure corresponding to the sum of the pressure loss and the difference in head at the location of the hydraulic pressure sensor 33 maintains a constant level irrespective of the changes in the ink level, as indicated by the constant pressure Ps in FIG. 5.

Figure 5:
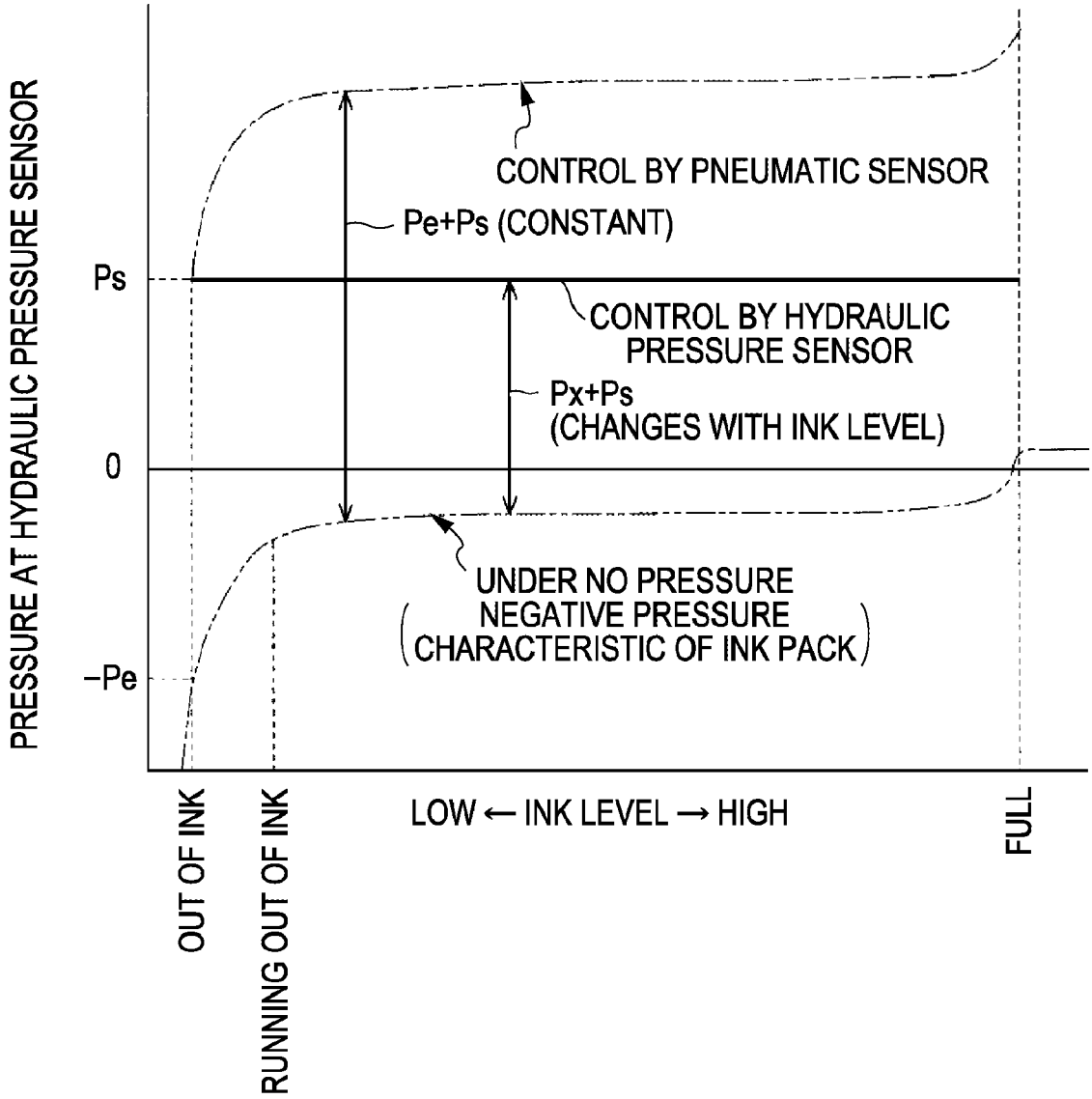
FIG. 5 is a graph showing the relationship between the remaining ink and the pressure in the ink feed channel.
Figure 6:
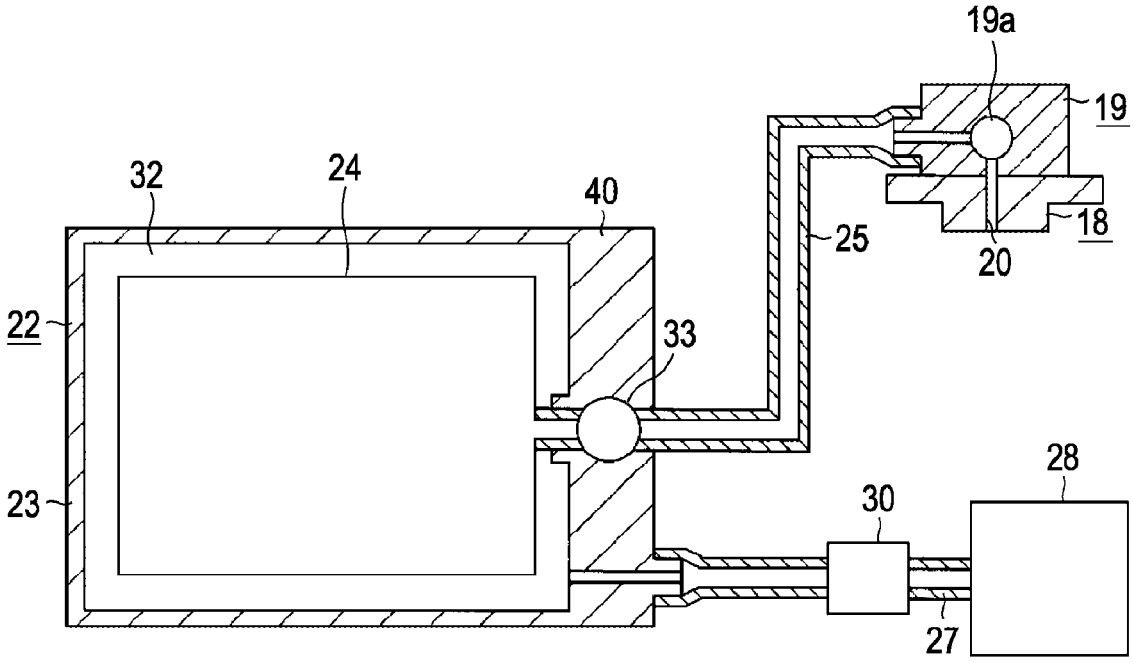
FIG. 6 is a schematic diagram illustrating the ink feed system of a printer according to a second embodiment of the invention.

On the other hand, the reaction force of the ink pack 24, shown under no pressure (the negative pressure characteristic of the ink pack) in FIG. 5, is low while the remaining ink is enough, increases gradually as the remaining ink decreases, and increases sharply as the ink pack 24 is about to run out of ink. The pressure corresponding to the reaction force of the ink pack 24 when it is determined that no ink remains, indicated by an at-ink-out reaction force Pe of FIG. 5, is significantly higher than the reaction force when the remaining ink is enough.

In this embodiment in which the pressure pump 28 is controlled on the basis of the hydraulic pressure Pi detected by the hydraulic pressure sensor 33 disposed in the ink feed channel 25 that is under no pressure, a pressurizing force corresponding to the pressure obtained by adding the reaction force Px of the ink pack 24 which changes with the remaining amount of ink to the constant pressure Ps is applied to the ink pack 24 disposed in the pressure region. In other words, in this embodiment, relatively low pressuring force is applied to the ink pack 24 until the ink pack 24 is about to run out of ink, and just before the ink pack 24 runs out of ink, a relatively high pressurizing force that is the sum of the constant pressure Ps and the at-out-of-ink reaction force Pe is applied to the ink pack 24.

In contrast, in the case where the pressure pump 28 is controlled on the basis the pressure of the pressurized air detected by the pneumatic sensor 29 disposed in the air feed channel 27, as in the related art, a high pressure that is the sum of the constant pressure Ps and the at-out-of-ink reaction force Pe is applied at all times. In other words, for pressurization based on the value sensed by the pneumatic sensor 29, the pressure pump 28 is excessively operated by the amount corresponding to the difference between the at-ink-out reaction force Pe and the reaction force Px that changes with the remaining amount of ink. In contrast, this embodiment allows effective pressurization control without such excessive operation.

If the hydraulic pressure Pi detected by the hydraulic pressure sensor 33 is lower than the hydraulic threshold value P1 during the period from the start to the end of the operation of the pressure pump 28, the control unit 35 determines that the ink cartridge 22 connected to the ink feed channel 25 at which the hydraulic pressure Pi lower than the hydraulic threshold value P1 is about to run out of ink. The determination is output to the display panel 34, so that the user can determine that the ink cartridge 22 is about to run out of ink.

If the hydraulic pressure Pi detected by the hydraulic pressure sensor 33 is equal to or higher than the air relieving threshold hydraulic pressure P3, the control unit 35 opens the air relief valve 30 to relieve the pressure in the air feed channel 27 into the air. That is, if the pressure of the ink flowing in the ink feed channel 25 becomes excessive due to some trouble, the introduction of the pressurized air into the pressure chamber 32 of the ink cartridge 22 is stopped, and thus an increase in the pressure in the ink feed channel 25, or a no pressure region, is suppressed.

The above-described first embodiment offers the following advantages:

An appropriate determination can be made whether the ink cartridge 22 is about to run out of ink when the hydraulic pressure sensor 33 detects the hydraulic pressure Pi lower than the threshold hydraulic pressure P1 during the period from the start to the end of the operation of the pressure pump 28. Design flexibility can be improved since the hydraulic pressure sensor 33 may be disposed anywhere along the ink feed channel 25.

The pressure applied from the pressure pump 28 to the ink cartridge 22 is generally determined in consideration of the pressure loss at the maximum ink flow rate, the difference between the heads of the ink cartridge 22 and the recording head 18, and the reaction force Pe of the ink pack 24 at the run-out of ink. However, the hydraulic pressure Pi detected by the hydraulic pressure sensor 33 disposed downstream from the pressure region in which the ink pack 24 is housed has already become a value obtained by subtracting the reaction force Px of the ink pack 24 corresponding to the actual remaining ink from the pressurizing force (pressurizing force−Px). Accordingly, the hydraulic pressure Pi can be controlled so as to be equal to or higher than the value Ps that is the sum of the pressure loss at the maximum ink flow rate and the difference between the heads of the ink cartridge 22 and the recording head 18 as follows:

$$Pi \geqq Ps$$

$$Pi = \text{Pressurizing force} - Px$$

Thus, $$\text{Pressurizing force} \geqq Ps + Px \text{ holds.}$$

Therefore, a pressurizing force corresponding to the pressure that is obtained by adding the reaction force Px that changes with the remaining ink to the fixed pressure Px (the sum of the pressure loss at the maximum ink flow rate and the difference between the heads of the liquid container and the liquid ejecting head) can be applied. In other words, when the operation of the pressure pump 28 is controlled on the basis of the hydraulic pressure Pi detected by the hydraulic pressure sensor 33 disposed in the ink feed channel 25 that is a no pressure region, there is no need to allow the high at-ink-out reaction force Pe for the pressurizing force. This permits effective control by preventing excessive operation of the pressure pump 28 by the amount of the pressure corresponding to the difference between the at-ink-out reaction force Pe and the reaction force Px that changes with the remaining ink.

(3) The upper limit of the pressurizing force can be controlled appropriately to prevent excessive operation of the pressure pump 28 by controlling the pressure pump 28 to operate until the pneumatic sensor 29 detects a pneumatic pressure Pa equal to or higher than the threshold pressurizing force P2.

(4) When the hydraulic sensor 33 detects a hydraulic pressure Pi equal to or higher than the predetermined air relieving threshold hydraulic pressure P3, the hydraulic sensor 33 is opened to communicate the air feed channel 27 with the air, thus preventing the pressurizing force from excessively increasing.

(5) In the case where the plurality of ink cartridges 22 is used, an appropriate determination of the different ink levels of the ink cartridges 22 can be made by the plurality of hydraulic pressure sensors 33 corresponding thereto.

Second Embodiment

Referring to FIGS. 1, 3, and 5 to 7, a second embodiment of the invention will be described.

This is also an ink jet printer according to an embodiment of the liquid ejecting apparatus of the invention, but is different from the first embodiment in the structure for feeding ink under pressure. The other points are principally the same as those of the first embodiment. Thus, only the differences from the first embodiment will principally be described.

Referring to FIG. 1, the pressurizing unit 26 of the first embodiment at the right end of the casing main body 12 and in the vicinity of the cartridge holder 21 is provided with the pressure pump 28, the pneumatic sensor 29, and the air relief valve 30. However, the pressurizing unit 26 of the second embodiment has no pneumatic sensor 29. Referring also to FIG. 1, the hydraulic pressure sensors 33 of the first embodiment are disposed along the ink feed channels 25 and in the vicinity of the valve units 19. However, the hydraulic sensors 33 of the second embodiment are each housed in the case 23 of the ink cartridge 22.

The interior of each ink cartridge 22 is divided into the pressure chamber 32 which is a pressure region pressurized by the pressure of pressurized air and a no pressure section 40 that is not pressurized by the pressure of the pressurized air. The pressure chamber 32 houses the ink pack 24, while the no pressure section 40 is provided with the hydraulic pressure sensor 33 for measuring the pressure of the ink fed from the pressure chamber 32 into the recording head 18 through the no pressure section 40. As described above, the air feed channel 27 shown in FIG. 6 has the air relief valve 30 but no pneumatic sensor 29.

The electrical structure of the printer 11 of the second embodiment will be described. This embodiment is different from the first embodiment in that the input-side interface is electrically connected to the hydraulic pressure sensor 33 but not to the pneumatic sensor 29.

With the printer 11 of this embodiment, if any of the hydraulic pressure sensors 33 disposed along the ink feed channels 25 within the no pressure section 40 detects a hydraulic pressure Pi lower than the predetermined threshold hydraulic pressure P1 during the standstill of the pressure pump 28, the control unit 35 sends a driving signal to the pressure pump 28 according to the program to start the operation of the pressure pump 28. When the operation time Tp of the pressure pump 28 counted by the timer 39 exceeds a predetermined time T1, the control unit 35 sends an operation stop signal to the pressure pump 28 to stop the operation of the pressure pump 28. The predetermined time T1 is the operation time of the pressure pump 28 necessary for increasing the pressurizing force to the upper limit to feed the ink from the ink cartridge 22 to the recording head 18.

If the hydraulic pressure sensor 33 detects a hydraulic pressure Pi lower than the threshold hydraulic pressure P1 during the period from the start to the end of the operation of the pressure pump 28, the control unit 35 determines that the ink cartridge 22 connected to the ink feed channel 25 at which the hydraulic pressure Pi lower than the threshold hydraulic pressure P1 is detected is about to run out of ink, and outputs the determination to the display panel 34.

Referring to the flowchart of FIG. 7, of the control routines executed by the control unit 35 of this embodiment, a pressurization control routine including ink level determination will be described.

In the pressurization control routine, the control unit 35 determines whether the hydraulic pressure Pi detected by any of the hydraulic pressure sensors 33 during the standstill of the pressure pump 28 is lower than the threshold hydraulic pressure P1 (step S20). If the determination is negative, the control unit 35 terminates this routine. If the determination in step S20 is positive, the control unit 35 outputs a driving signal to the driving circuit for the pressure pump 28 to start the operation of the pressure pump 28 (step S21).

Subsequently, the control unit 35 determines whether the hydraulic pressure Pi detected by the hydraulic pressure sensor 33 is equal to or higher than the threshold hydraulic pressure P1 (step S22). If the determination in step S22 is positive, the control unit 35 determines whether the operation time Tp of the pressure pump 28 counted by the timer 39 has exceeded the predetermined time T1 (step S23). If the determination is negative, the control unit 35 executes the determination of step S23 again. If the determination in step S23 is positive, the control unit 35 stops the operation of the pressure pump 28 (step S24), and terminates the routine.

If the determination in step S22 is negative, then the control unit 35 determines whether the pressure pump 28 is in operation (step S25). If the determination in step S25 is positive, the control unit 35 determines that the ink cartridge 22 connected to the ink feed channel 25 in which the hydraulic pressure Pi lower than the threshold hydraulic pressure P1 is detected in steps S20 and S22 is about to run out of ink (step S26). Then, the control unit 35 outputs the determination to the display panel 34 (step S27), and terminates the routine.

The operation of the printer 11 will next be described.

If any of the hydraulic pressure sensors 33 disposed along ink feed channels 25 within the no pressure section 40 detects a hydraulic pressure Pi lower than the threshold hydraulic pressure P1, the operation of the pressure pump 28 is started. When the pressure pump 28 is operated, so that the hydraulic pressure Pi of the hydraulic pressure sensor 33 becomes equal to or higher than the threshold hydraulic pressure P1, the ink flowing in the ink feed channel 25 is fed to the recording head 18 because the pressure of the ink flowing in the ink feed channel 25 has increased enough.

Subsequently, when the operation time Tp after the start of the pressure pump 28 reaches the predetermined time T1, the pressure pump 28 is stopped. The predetermined time T1 is set in advance to increase the pressurizing force necessary for feeding ink from the ink cartridge 22 to the recording head 18 to the upper limit. Therefore, the pressure pump 28 is not operated excessively.

Thus, the hydraulic pressure of the no pressure region (the pressure of the ink flowing in the ink feed channel 25) is maintained within a predetermined range necessary for feeding the ink from the ink cartridge 22 to the recording head 18.

The second embodiment described above offers the following advantages, in addition to the advantages (1) to (5) of the first embodiment.

(6) The time T1 for increasing the pressurizing force necessary for feeding ink from the ink cartridge 22 to the recording head 18 to the upper limit is set in advance. When the operation time Tp exceeds the predetermined time T1 after the pressure pump 28 is started, the pressure pump 28 is stopped. This eliminates the need for means for measuring the pressurizing force (e.g., a pneumatic sensor) to control the upper limit of the pressurizing force appropriately. This allows the upper limit of the pressurizing force to be controlled appropriately without increasing the number of the components, thereby preventing excessive operation of the pressure pump 28.

(7) Since the hydraulic pressure sensor 33 is integrated with the ink cartridge 22, the hydraulic pressure sensor 33 can be replaced every time the ink cartridge 22 is replaced, thus maintaining high reliability of the hydraulic pressure sensor 33 in this respect, and furthermore, allowing the ink cartridge 22 equipped with the hydraulic pressure sensor 33 to be attached to an existing liquid ejecting apparatus having no hydraulic pressure sensor 33 to check the liquid level.

Other Embodiments

The foregoing embodiments can be modified as follows:

The second embodiment may be constructed such that the no pressure section 40 of the ink cartridge 22 may be an air chamber separate from the pressure chamber 32 in the case 23 of the ink cartridge 22 so as not to be pressurized by the pressure of the pressurized air.

Although the second embodiment is constructed such that the hydraulic pressure sensor 33 is integrated with the ink cartridge 22, the no pressure section 40 having the hydraulic pressure sensor 33 may be detached from the case 23 so that the hydraulic pressure sensor 33 can be reused when the ink cartridge 22 is replaced.

Figure 4:
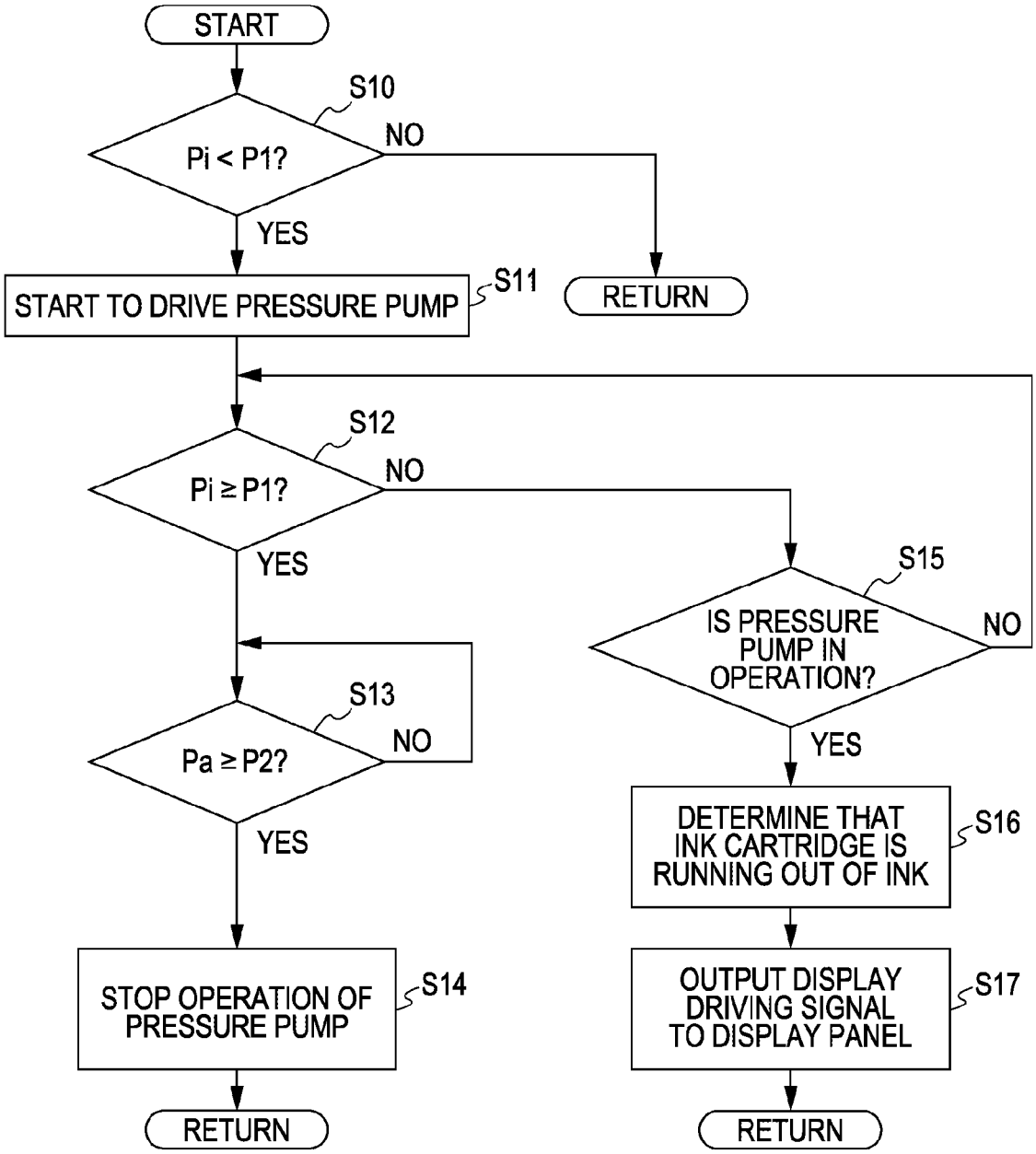
FIG. 4 is a flowchart for a pressurization control routine of the first embodiment.
Figure 8:
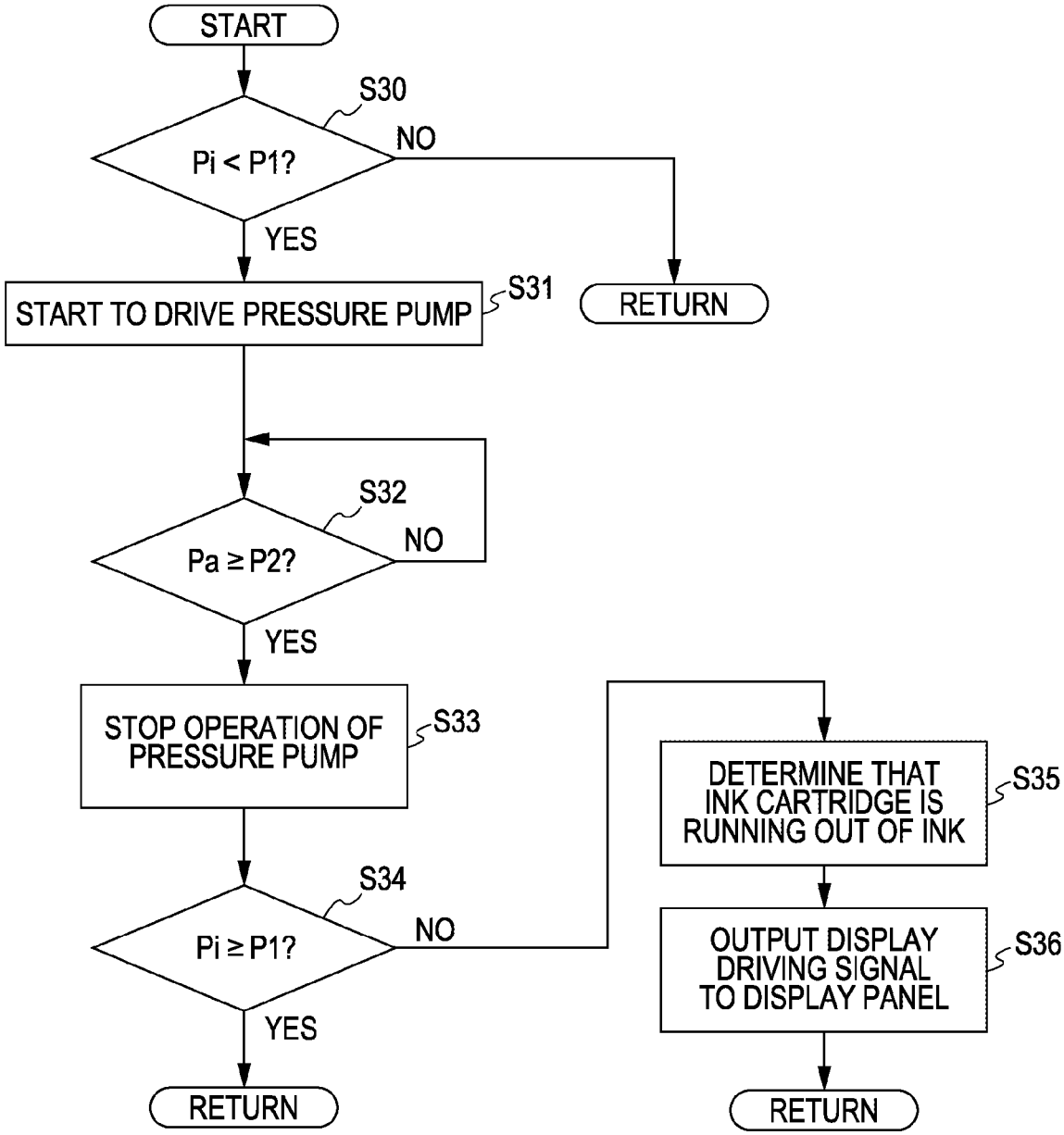
FIG. 8 is a flowchart for a pressurization control routine of another embodiment.

The foregoing embodiments may be constructed such that the hydraulic pressure sensor 33 determines that the ink pack 24 is about to run out of liquid when the hydraulic pressure sensor 33 detects the hydraulic pressure Pi lower than the threshold hydraulic pressure P1 immediately after the pressure pump 28 stops. In this case, the pressurization control routine executed by the control unit 35 is as follows:

First, the flowchart of the first embodiment shown in FIG. 4 is changed to the flowchart shown in FIG. 8. Specifically, the control unit 35 determines whether the hydraulic pressure Pi detected by any of the hydraulic pressure sensors 33 during the standstill of the pressure pump 28 is lower than the threshold hydraulic pressure P1 (step S30). If the determination is negative, the control unit 35 terminates this routine. If the determination in step S30 is positive, the control unit 35 outputs a driving signal to the driving circuit for the pressure pump 28 to start the operation of the pressure pump 28 (step S31).

Subsequently, the control unit 35 determines whether the hydraulic pressure Pa detected by the hydraulic pressure sensor 33 is equal to or higher than the threshold pressurizing force P2 (step S32). If the determination is negative, the control unit 35 executes the determination of step S32 again. In contrast, if the determination in step S32 is positive, the control unit 35 outputs an operation stop signal to the driving circuit for the pressure pump 28 to stop the operation of the pressure pump 28 (step S33).

Immediately after stopping the operation of the pressure pump 28, the control unit 35 determines whether the hydraulic pressure Pi detected by the hydraulic pressure sensor 33 is equal to or higher than the threshold hydraulic pressure P1 (step S34). If the determination in step S34 is positive, the control unit 35 terminates this routine. On the other hand, if the determination in step S34 is negative, the control unit 35 determines that the ink cartridge 22 connected to the ink feed channel 25 at which the hydraulic pressure Pi lower than the threshold hydraulic pressure P1 is detected in step S34 is about to run out of ink (step S35). The control unit 35 then outputs a display driving signal for displaying the determination to the driving circuit for the display panel 34 (step S36), and terminates the routine.

Figure 7:
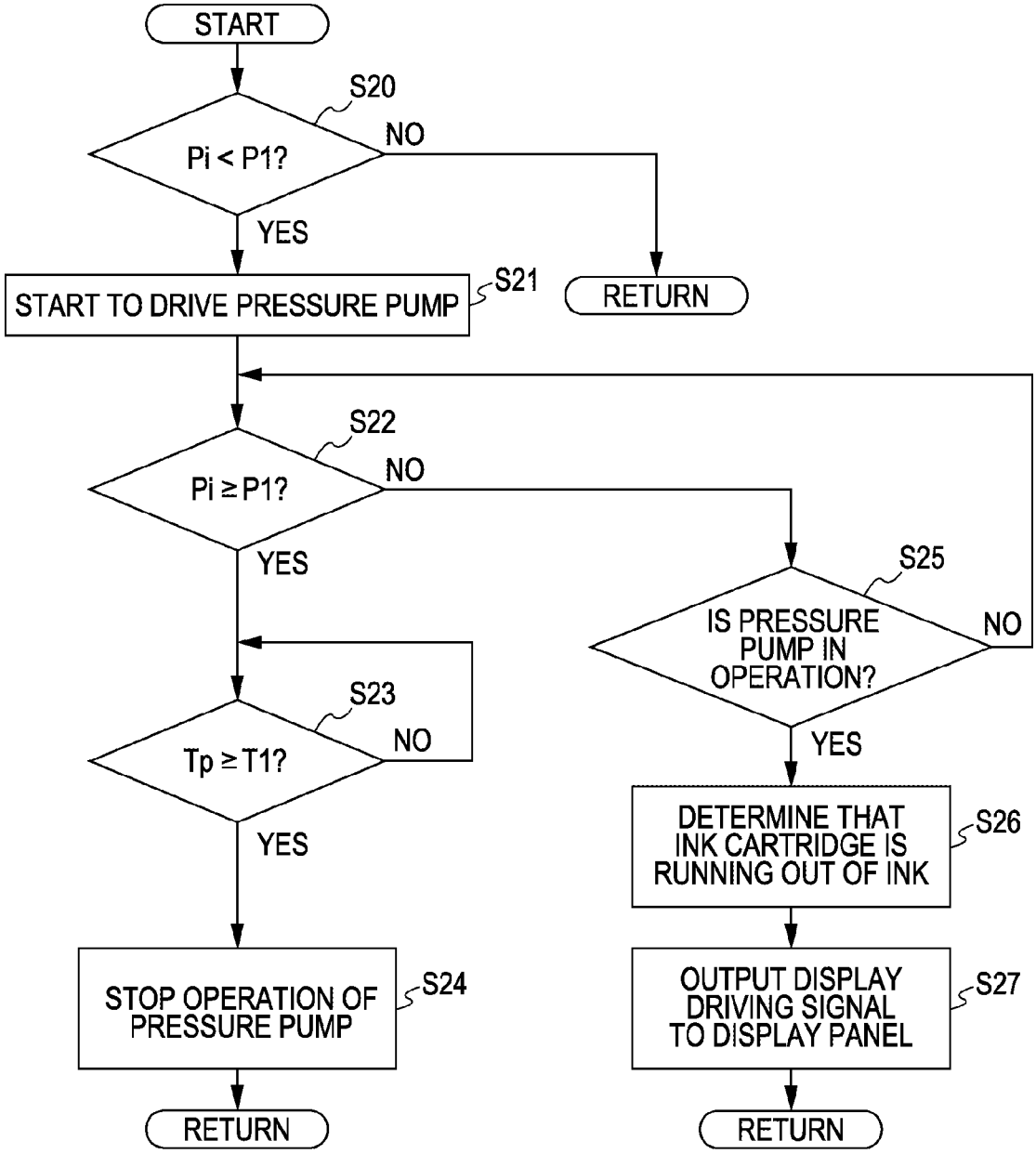
FIG. 7 is a flowchart for a pressurization control routine of the second embodiment.
Figure 9:
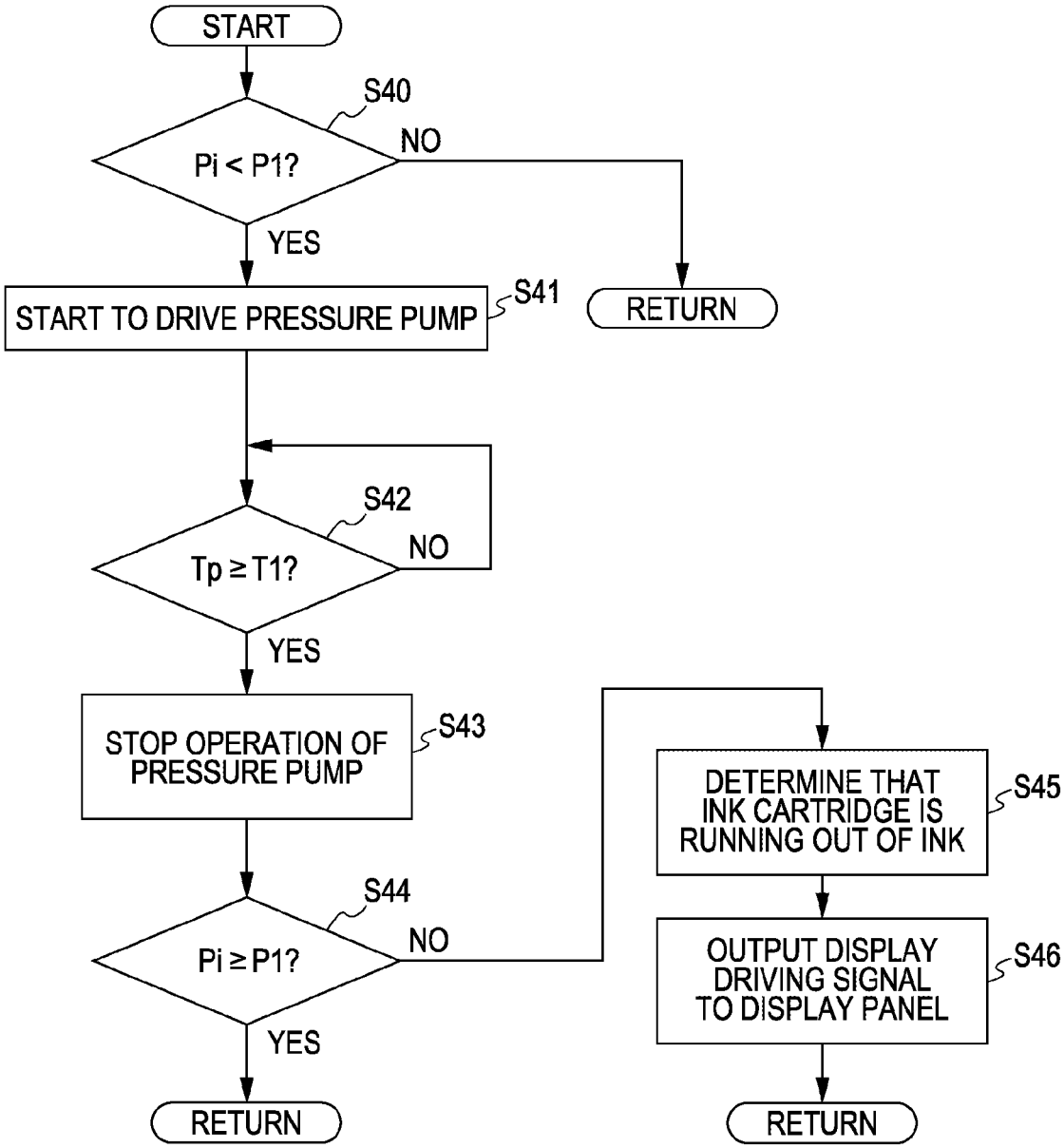
FIG. 9 is a flowchart for a pressurization control routine of still another embodiment.

The flowchart of the second embodiment, shown in FIG. 7, can be modified to the flowchart of FIG. 9. Specifically, the control unit 35 determines whether the hydraulic pressure Pi detected by any of the hydraulic pressure sensors 33 during the standstill of the pressure pump 28 is lower than the threshold hydraulic pressure P1 (step S40). If the determination is negative, the control unit 35 terminates this routine. If the determination in step S40 is positive, the control unit 35 outputs a driving signal to the driving circuit for the pressure pump 28 to start the operation of the pressure pump 28 (step S41).

Subsequently, the control unit 35 determines whether the operation time Tp of the pressure pump 28 counted by the timer 39 has exceeded the predetermined time T1 (step S42). If the determination is negative, the control unit 35 executes the determination of step S42 again. If the determination in step S42 is positive, the control unit 35 stops the operation of the pressure pump 28 (step S43).

Immediately after stopping the operation of the pressure pump 28, the control unit 35 determines whether the hydraulic pressure Pi detected by the hydraulic pressure sensor 33 is equal to or higher than the threshold hydraulic pressure P1 (step S44). If the determination in step S44 is positive, the control unit 35 terminates this routine. On the other hand, if the determination in step S44 is negative, the control unit 35 determines that the ink cartridge 22 connected to the ink feed channel 25 at which the hydraulic pressure Pi lower than the threshold hydraulic pressure P1 is detected in step S44 is about to run out of ink (step S45). The control unit 35 then outputs the determination to the display panel 34 (step S46), and terminates the routine.

The foregoing embodiments are constructed such that all the ink cartridges 22 each have a corresponding individual hydraulic pressure sensor 33. Instead, only part of the ink cartridges 22, of highly-used colors or low capacity, may have the hydraulic pressure sensor 33.

The foregoing embodiments may omit the air relief valve 30 that communicates the pressure region with the air when opened.

The foregoing embodiments are configured such that if the hydraulic pressure sensor 33 detects a hydraulic pressure Pi lower than the threshold hydraulic pressure P1 during the period from the start to the end of the operation of the pressure pump 28 (or immediately after it is stopped), the control unit 35 determines that the ink pack 24 is about to run out of liquid; instead, the control unit 35 may determine that the ink pack 24 has run out of ink, not that the ink pack 24 is about to run out of ink.

The foregoing embodiments are configured such that the determination on ink level is output to the display panel 34. However, means for indicating the determination may not be limited to the display panel disposed on the upper surface of the casing main body 12; instead, an LED may be lit (or blinked or turned off) or a buzzer or a bell may be rung. If the printer 11 is connected to a personal computer, the determination may be displayed on the monitor of the personal computer.

While the foregoing embodiments are described for the case in which the liquid ejecting apparatus of the invention is applied to ink jet printers, the invention can also be applied to other liquid ejecting apparatus; for example, printers for use in facsimile machines and copying machines, liquid ejecting apparatuses that eject electrode materials or color materials for use in manufacturing liquid crystal displays, EL displays, or surface-emitting displays, liquid ejecting apparatuses that eject organic matters for use in manufacturing biochips, and sample ejecting apparatuses or precision pipettes.

The technical spirit grasped from the foregoing embodiments and modifications will be described as follows, together with their advantages:

A liquid ejecting apparatus includes: a liquid ejecting head that can eject liquid; a pressure pump that discharges pressurized air during operation; at least one liquid container that contains liquid; a pressurized-air feed channel that feeds the liquid container with the pressurized air discharged from the pressure pump; a liquid feed channel that feeds the liquid ejecting head with the liquid discharged from the liquid container in accordance with the pressure of the pressurized air that is fed to the liquid container through the pressurized-air feed channel; a hydraulic-pressure measuring device disposed in a no pressure region that is not under the pressure of the pressurized air, for measuring the pressure of the liquid fed from the liquid container to the liquid ejecting head; a determining section that determines, if the hydraulic-pressure measuring device detects a value lower than a threshold hydraulic pressure predetermined as the lower limit of the hydraulic pressure necessary for feeding the liquid from the liquid container to the liquid ejecting head during the period from the start to the end of the operation of the pressure pump or immediately after the operation stops, that the liquid container has run out or is about to run out of liquid; and a controller that controls the operation of the pressure pump on the basis of the measurement of the hydraulic-pressure measuring device.

The arrangement provides a pressure pump control based on the hydraulic pressure detected by the hydraulic-pressure measuring device disposed in the no pressure region, allowing an effective control by preventing excessive operation of the pressure pump.

What is claimed is:

1. A liquid ejecting apparatus comprising:

a liquid ejecting head that can eject liquid;

a pressure pump that discharges pressurized air during operation;

at least one liquid container that contains liquid;

a pressurized-air feed channel that feeds the liquid container with the pressurized air discharged from the pressure pump;

a liquid feed channel that feeds the liquid ejecting head with the liquid discharged from the liquid container in accordance with the pressure of the pressurized air that is fed to the liquid container through the pressurized-air feed channel;

a hydraulic-pressure measuring device disposed in a no pressure region that is not under the pressure of the pressurized air, for measuring the pressure of the liquid fed from the liquid container to the liquid ejecting head;

a determining section that determines a low liquid condition when the hydraulic-pressure measuring device detects a value lower than a threshold hydraulic pressure, predetermined as the lower limit of the hydraulic pressure necessary for feeding the liquid from the liquid container to the liquid ejecting head during the period from the start to the end of the operation of the pressure pump or immediately after the operation stops; and a controller that controls the operation of the pressure pump on the basis of the measurement of the hydraulic-pressure measuring device.

2. The liquid ejecting apparatus according to claim 1, wherein the controller starts the operation of the pressure pump when the hydraulic-pressure measuring device detects a value lower than the threshold hydraulic pressure while the pressure pump is at a standstill.

3. The liquid ejecting apparatus according to claim 2, further comprising:

at least one pressurizing-force measuring device that is disposed in a pressure region that is under the pressure of the pressurized air and that measures the pressure of the pressurized air, wherein the controller stops the operation of the pressure pump when the pressurizing force measuring device detects a value equal to or higher than a threshold pressurizing force predetermined as the upper limit of the pressurizing force necessary for feeding the liquid from the liquid container to the liquid ejecting head after starting the operation of the pressure pump.

4. The liquid ejecting apparatus according to claim 2, wherein the controller operates the pressure pump for a predetermined time necessary for increasing the pressurizing force to the upper limit of the pressurizing force necessary for feeding the liquid from the liquid container to the liquid ejecting head after starting the operation of the pressure pump.

5. The liquid ejecting apparatus according to claim 1, further comprising:

an air relief valve that communicates the pressure region with the air when opened, wherein if the hydraulic-pressure measuring device detects a value equal to or higher than an air-relieving threshold hydraulic pressure predetermined for opening the air relief valve, the controller opens the air relief valve.

6. The liquid ejecting apparatus according to claim 1, wherein the at least one liquid container comprises a plurality of liquid containers, and the at least one hydraulic-pressure measuring device comprises a plurality of hydraulic-pressure measuring devices in one-to-one correspondence with the liquid containers.

7. The liquid ejecting apparatus according to claim 1, wherein the liquid container is divided into a pressure region that is pressurized by the pressurized air and a no pressure region that is not pressurized by the pressurized air, the pressure region containing the liquid, and the no pressure region having the hydraulic-pressure measuring device.

8. A liquid container mounted on the liquid ejecting apparatus according to claim 1, wherein the interior of the liquid container is divided into a pressure region that is pressurized by the pressurized air and a no pressure region that is not pressurized by the pressurized air, the pressure region containing the liquid, and the no pressure region having a hydraulic-pressure measuring device that detects the pressure of the liquid fed from the pressure region to the liquid ejecting head through the no pressure region.

9. A method, for determining the liquid level of a liquid container, comprising:

measuring the pressure of the liquid fed from a liquid container to a liquid ejecting head in accordance with the pressure of the pressurized air discharged from a pressure pump by a hydraulic-pressure measuring device disposed in a no pressure region that is not pressurized by the pressurized air; and determining, when the hydraulic-pressure measuring device detects a value lower than a threshold hydraulic pressure predetermined as the lower limit of the hydraulic pressure necessary for feeding the liquid from the liquid container to the liquid ejecting head during the period from the start to the end of the operation of the pressure pump or immediately after the operation stops, that the liquid container has run out or is about to run out of liquid.

10. A liquid ejecting apparatus, comprising:

a determining section;

a container of liquid;

a pressurized-air feed channel communicating pressurized air to the container from a pressure pump;

a liquid feed channel communicating the liquid from the container to a liquid ejection head, in response to the pressure of the pressurized air; and a liquid pressure sensor disposed along the liquid feed channel, in a region not under the pressure of the pressurized air;

wherein:

when the liquid pressure sensor indicates a value, lower than a threshold hydraulic pressure, directly after ceasing a pressure pump operation, the determining section indicates a low liquid condition;

the threshold hydraulic pressure is predetermined and represents a lower limit of a hydraulic pressure necessary for feeding the liquid from the containers to the liquid ejection head; and the pressure pump is controlled based on an output of the liquid pressure sensor.

* * * * *